US009660341B2

(12) United States Patent
Ishizuka et al.

(10) Patent No.: US 9,660,341 B2
(45) Date of Patent: May 23, 2017

(54) SIGNAL LINE MODULE AND COMMUNICATION TERMINAL APPARATUS

(71) Applicant: Murata Manufacturing Co., Ltd., Nagaokakyo-shi, Kyoto-fu (JP)

(72) Inventors: Kenichi Ishizuka, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/641,555

(22) Filed: Mar. 9, 2015

(65) Prior Publication Data

US 2015/0180125 A1 Jun. 25, 2015

Related U.S. Application Data

(63) Continuation of application No. PCT/JP2013/067800, filed on Jun. 28, 2013.

(30) Foreign Application Priority Data

Sep. 28, 2012 (JP) ..... 2012-215393

(51) Int. Cl.
*H01Q 5/335* (2015.01)
*H01Q 1/24* (2006.01)
(Continued)

(52) U.S. Cl.
CPC ..... *H01Q 5/335* (2015.01); *H01P 3/085* (2013.01); *H01Q 1/243* (2013.01); *H01Q 9/26* (2013.01); *H01Q 9/42* (2013.01)

(58) Field of Classification Search
CPC H01Q 5/335; H01Q 5/50; H01P 3/085–3/087
See application file for complete search history.

(56) References Cited

U.S. PATENT DOCUMENTS

2009/0109106 A1 4/2009 Tsubaki et al.
2012/0056795 A1 3/2012 Nagumo et al.
2013/0038501 A1 2/2013 Kato et al.

FOREIGN PATENT DOCUMENTS

CN 102280706 A 12/2011
CN 102484312 A 5/2012
(Continued)

OTHER PUBLICATIONS

Official Communication issued in corresponding Chinese Patent Application No. 2013800506483, mailed on Oct. 27, 2015.
(Continued)

*Primary Examiner* — Robert Karacsony
*Assistant Examiner* — Amal Patel
(74) *Attorney, Agent, or Firm* — Keating & Bennett, LLP

(57) ABSTRACT

In a signal line module and a communication terminal apparatus, a first connection portion connected to a feeding circuit, a second connection portion connected to a radiation element, a first high-frequency line portion, a second high-frequency line portion, and a matching circuit portion defining all of or a portion of a first matching circuit are integrally provided in a multilayer body including a plurality of base material layers. The first connection portion, the first high-frequency line portion, and the matching circuit portion are in a ground zone superposed with a ground conductor, when viewed in plan in a stacking direction of the multilayer body, and the second high-frequency line portion and the second connection portion are in a non-ground zone. The second high-frequency line portion and the second connection portion, together with the radiation element, operate as a radiation portion.

19 Claims, 14 Drawing Sheets

(51) Int. Cl.

| | |
|---|---|
| ***H01Q 1/48*** | (2006.01) |
| ***H01Q 9/42*** | (2006.01) |
| ***H01Q 9/26*** | (2006.01) |
| ***H01P 3/08*** | (2006.01) |

(56) References Cited

FOREIGN PATENT DOCUMENTS

| | | | |
|---|---|---|---|
| JP | 2004-320520 | A | 11/2004 |
| JP | 2005-217856 | A | 8/2005 |
| JP | 2006-325093 | A | 11/2006 |
| WO | 2007/145114 | A1 | 12/2007 |
| WO | 2010/113353 | A1 | 10/2010 |
| WO | 2011/021677 | A1 | 2/2011 |

OTHER PUBLICATIONS

Official Communication issued in International Patent Application No. PCT/JP2013/067800 mailed on Sep. 24, 2013.
Official Communication issued in corresponding Japanese Patent Application No. 2014-093289, mailed on Dec. 24, 2014.

PRIOR ART

SIGNAL LINE MODULE AND COMMUNICATION TERMINAL APPARATUS

BACKGROUND OF THE INVENTION

1. Field of the Invention

The present invention relates to a signal line module, in which functionality has been added to a signal line, and to a communication terminal including such a signal line module.

2. Description of the Related Art

To date, communication terminal apparatuses such as cellular phones have become more compact and functional. Hence, due to restrictions in positions at which various electronic components are arranged in a communication terminal apparatus, a feeding circuit device such as an RFIC chip needs to be placed in a position spaced apart from a radiation element in some cases. An example configuration in such a case is disclosed in, for example, Japanese Unexamined Patent Application Publication No. 2006-325093.

FIG. 14 is a schematic configuration diagram of a communication terminal apparatus disclosed in Japanese Unexamined Patent Application Publication No. 2006-325093. Here, a substrate 2 including a substrate ground formed thereon, an antenna 5, and a wireless circuit 3 are housed in a casing 1. The wireless circuit 3 is connected to the antenna 5 through a feed line 4 and an antenna matching circuit 8.

However, in general, connectors need to be used when a coaxial cable (the feed line 4 in the example of FIG. 14) is connected to an RFIC (the wireless circuit 3) and the antenna matching circuit 8 and, hence, power transmission loss due to an impedance mismatch between the line and the connectors may be generated. Further, since a matching circuit needs to be arranged in the vicinity of a radiation element (the antenna 5), a separate substrate for the matching circuit needs to be arranged in the vicinity of the radiation element. Hence, the antenna characteristics of the radiation element may be degraded due to the influence of a ground conductor formed on this separate substrate.

SUMMARY OF THE INVENTION

Accordingly, preferred embodiments of the present invention provide a signal line module in which power transmission loss and degradation of the antenna characteristics of a radiation element are significantly reduced or prevented, and provide a communication terminal apparatus including such a signal line module.

A signal line module according to a preferred embodiment of the present invention includes a first connection portion connected to a feeding circuit; a second connection portion connected to a radiation element; a first high-frequency line portion, one end of which is connected to the first connection portion; a second high-frequency line portion, one end of which is connected to the second connection portion; and a first matching circuit portion between a second end of the first high-frequency line portion and a second end of the second high-frequency line portion and that defines all or a portion of a matching circuit configured to perform impedance matching between the first high-frequency line portion and the second high-frequency line portion.

The first connection portion, the first high-frequency line portion, the first matching circuit portion, the second high-frequency line portion, and the second connection portion preferably are integrally provided in a multilayer body including a plurality of base material layers stacked on top of one another.

The first connection portion, the first high-frequency line portion, and the first matching circuit portion are located in a ground zone superposed with a ground conductor, and the second high-frequency line portion and the second connection portion are located outside of the ground zone, when viewed in plan in a stacking direction of the multilayer body.

The second high-frequency line portion and the second connection portion, together with the radiation element, define and operate as a radiation portion (radiation body).

According to another preferred embodiment of the present invention, the first matching circuit portion preferably defines by itself the matching circuit configured to perform impedance matching between the first high-frequency line portion and the second high-frequency line portion, or the first high-frequency line portion and the first matching circuit portion preferably define the matching circuit together.

It is preferable that the first matching circuit portion including a conductor pattern located in the multilayer body.

The signal line module preferably further includes a third connection portion that is electrically connected to the ground conductor, and that is connected to a grounding point of the radiation element or to a non-feeding radiation element.

It is preferable that the first high-frequency line portion include a second matching circuit portion, and the first high-frequency line portion, the first matching circuit portion, and the second matching circuit portion define the matching circuit, as necessary.

According to a further preferred embodiment of the present invention, a communication terminal apparatus includes a feeding circuit and a radiation element. The feeding circuit and the radiation element are connected to each other through a signal line module. The signal line module includes a first connection portion connected to a feeding circuit; a second connection portion connected to a radiation element; a first high-frequency line portion, one end of which is connected to the first connection portion; a second high-frequency line portion, one end of which is connected to the second connection portion; and a first matching circuit portion between a second end of the first high-frequency line portion and a second end of the second high-frequency line portion and that defines all of or a portion of a matching circuit configured to perform impedance matching between the first high-frequency line portion and the second high-frequency line portion.

The first connection portion, the first high-frequency line portion, the first matching circuit portion, the second high-frequency line portion, and the second connection portion are integrally provided in a multilayer body including a plurality of base material layers stacked on top of one another.

The first connection portion, the first high-frequency line portion, and the first matching circuit portion are located in a ground zone superposed with a ground conductor, and the second high-frequency line portion and the second connection portion are located outside of the ground zone, when viewed in plan in a stacking direction of the multilayer body.

The second high-frequency line portion and the second connection portion, together with the radiation element, define and operate as a radiation portion.

According to various preferred embodiments of the present invention, the high-frequency line portion and the matching circuit portion preferably are integrated. Hence, generation of standing waves corresponding to the electrical length of a line between the connectors, due to an impedance mismatch between the line and connectors, is significantly reduced or prevented such that low-loss power transmission is realized. Further, the signal line module according to various preferred embodiments of the present invention does not need a separate substrate for a matching circuit and, hence, a relatively large ground conductor is not arranged near the radiation element, such that degradation of the radiation characteristics of an antenna is significantly reduced or prevented. Further, since the second high-frequency line portion is located near the non-ground zone, this portion is capable of being utilized as a radiation element. In addition, since the signal line module according to various preferred embodiments of the present invention does not need a separate substrate for a matching circuit, reduction in size is achieved.

Hence, in various preferred embodiments of the present invention, a signal line module with low transmission loss for a high-frequency signal and an excellent radiation gain is provided. By using this signal line module, a communication terminal apparatus with a simple configuration is realized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
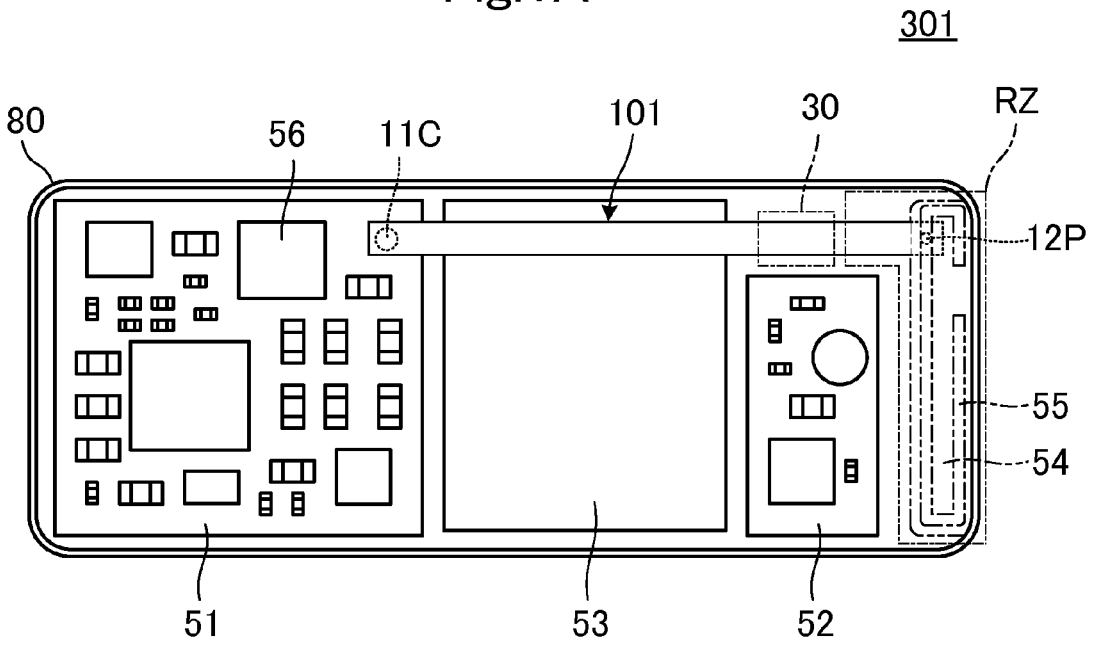
FIG. 1A is a diagram illustrating the structure of the inside of a communication terminal apparatus on the upper casing side, the communication terminal apparatus including a signal line module according to a first preferred embodiment of the present invention, in a state in which the lower casing has been removed.
Figure 1B:
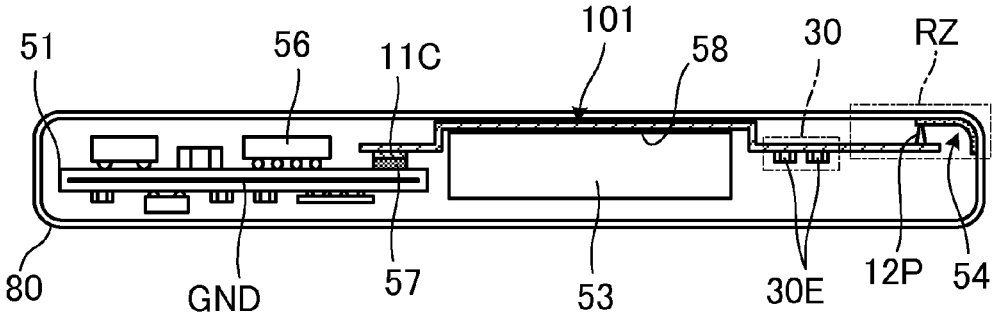
FIG. 1B is a longitudinal sectional view of the communication terminal apparatus.

FIG. 1A is a diagram illustrating a communication terminal apparatus 301 including a signal line module according to a first preferred embodiment of the present invention in a state in which the lower casing (casing on a display panel side) has been removed, i.e., the structure of the inside of a communication terminal apparatus on the upper casing. The communication terminal apparatus 301 preferably is a smart phone supporting a cellular communication system such as GSM (registered trademark). Note that, a radiation board 54 that is attached to the inner surface of the lower casing is illustrated after detaching it from the lower casing. FIG. 1B is a longitudinal sectional view of the communication terminal apparatus 301.

Printed wire boards 51 and 52, a battery pack 53, and the like are housed in a casing 80. A plurality of electronic components including an RFIC 56 that includes a communication circuit are mounted on the printed wire board 51. A camera module and other electronic components are mounted on the printed wire board 52.

The radiation board 54 is attached to one corner of the lower casing. The radiation board 54 includes a UHF-band radiation element 55 for cellular communication, such as GSM (registered trademark), located thereon.

The printed wire board 51 and the radiation board 54 are connected to each other through a signal line module 101. The signal line module 101 is provided with a connector 11C, which is a first connection portion, located at one end portion thereof and a connection pin 12P, which is a second connection portion, located at the other end portion thereof. The printed wire board 51 is provided with a receptacle 57, to which the connector 11C is attached. The connection pin 12P of the signal line module 101 comes into contact with a feeding point for the radiation element 55 of the radiation board 54.

The signal line module 101 is adhesively fixed to a battery pack 53 through an adhesive layer 58. Matching circuit devices 30E are mounted in a matching circuit portion 30 of the signal line module 101. As described in detail later, a portion of the signal line module 101 operates, together with the radiation board 54, as a radiation portion RZ.

Figure 2:
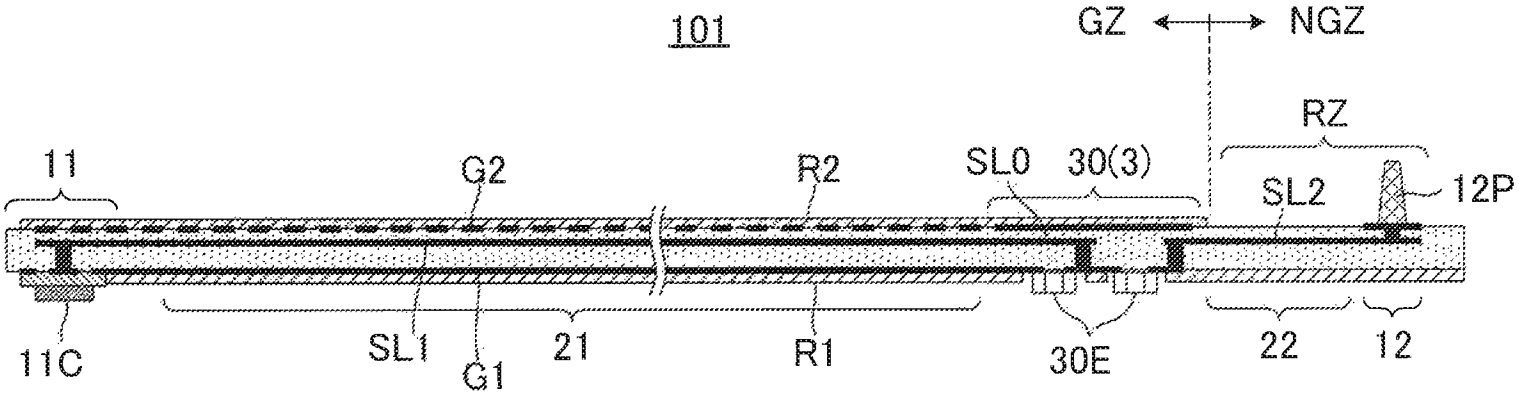
FIG. 2 is a longitudinal sectional view of the signal line module.
Figure 3B:
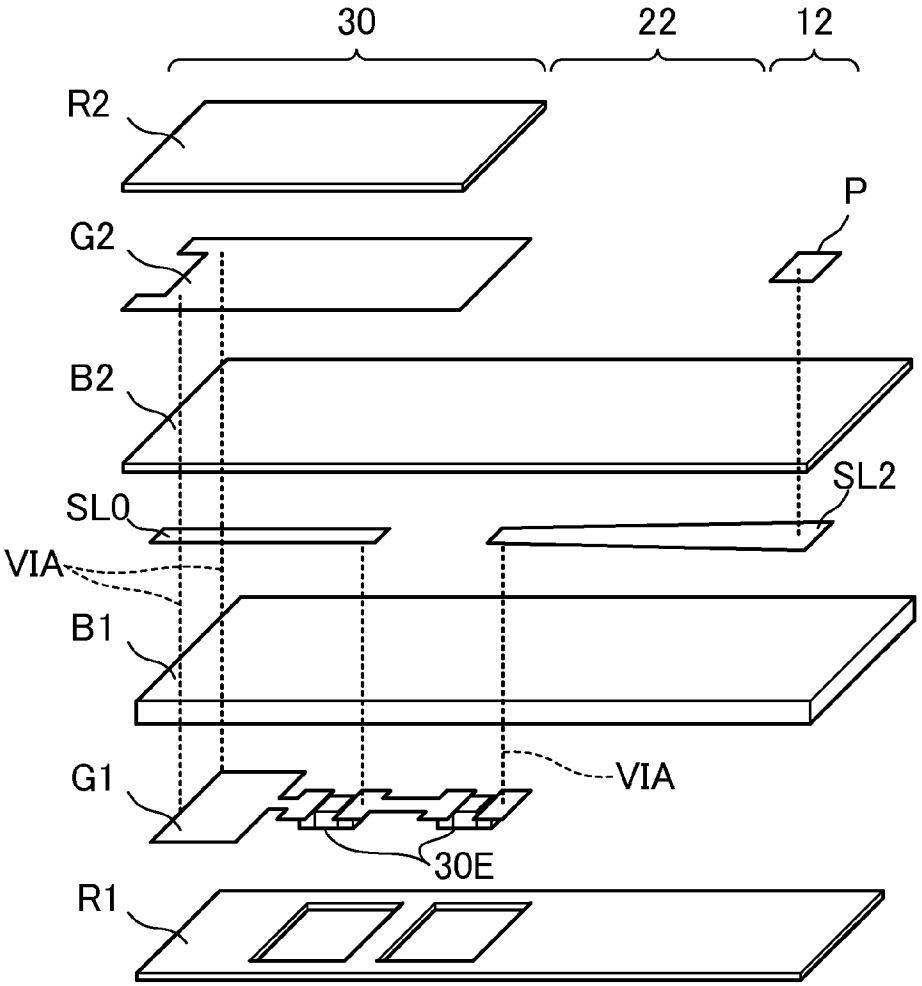
FIG. 3B is an exploded perspective view of a region including a matching circuit portion, a second high-frequency line portion, and a second connection portion.
Figure 3A:
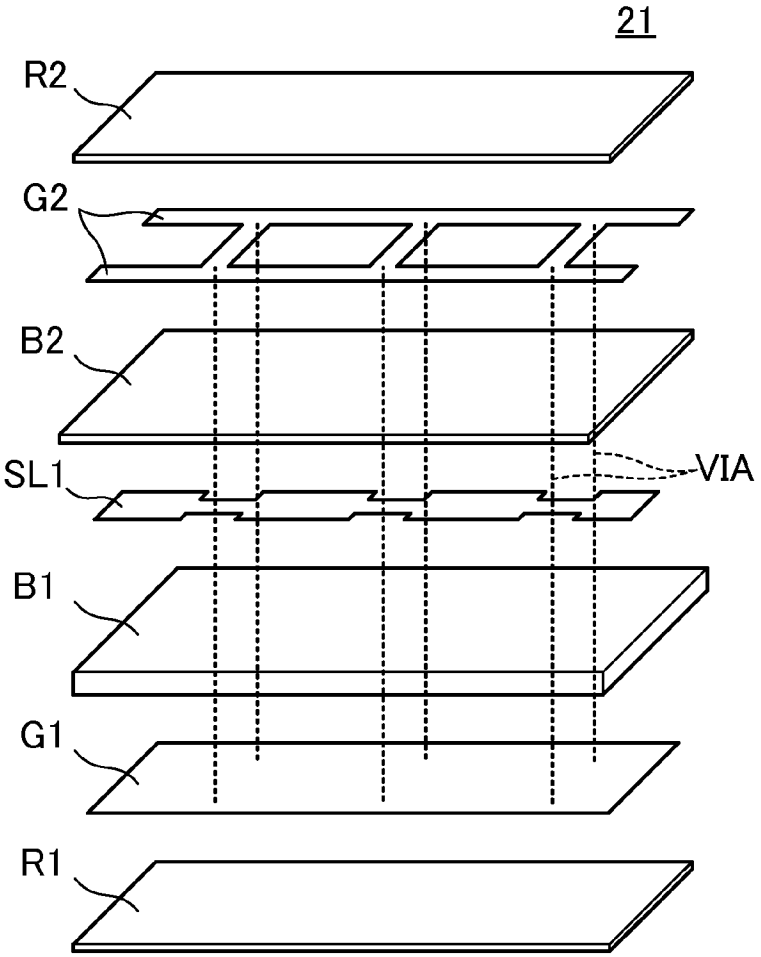
FIG. 3A is a partial exploded perspective view of a first high-frequency line portion.

FIG. 2 is a longitudinal sectional view of the signal line module 101. Note that the dimension in the thickness direction is disproportionately larger than the actual dimension in FIG. 2, to clarify the sectional structure. FIG. 3A is a partial exploded perspective view of a first high-frequency line portion 21. FIG. 3B is an exploded perspective view of a zone including the matching circuit portion 30, a second high-frequency line portion 22, and a second connection portion 12.

As illustrated in FIG. 2, the connector 11C is provided in a first connection portion 11, and the connection pin 12P is provided in the second connection portion 12. The first connection portion 11, the first high-frequency line portion 21, and the matching circuit portion 30 are located in a ground zone GZ, where a ground conductor is located. The second high-frequency line portion 22 and the second connection portion 12 are located in a non-ground zone NGZ, where no ground conductors are located.

Hereinafter, referring to FIG. 2, the structure of the signal line module 101 is described in detail. The signal line module 101 has a base body which is a multilayer body including a plurality of dielectric layers stacked on top of one another.

The connector 11C is a connection terminal to be connected to a feeding circuit that includes an RFIC chip for cellular communication, and is connected to a first end of a signal line SL1 of the first high-frequency line portion 21 through an interlayer connection conductor. The connector 11C is mounted on the other main surface side of the multilayer body. A second end of the signal line SL1 of the first high-frequency line portion 21 is connected to one end of the matching circuit portion 30. The other end of the matching circuit portion 30 is connected to a second end of a signal line SL2 of the second high-frequency line portion 22. A first end of the signal line SL2 of the second high-frequency line portion 22 is connected to the connection pin 12P. In other words, an output signal supplied from the feeding circuit is supplied to an antenna element through the connector 11C, the first high-frequency line portion 21, the matching circuit portion 30, the second high-frequency line portion 22, and the connection pin 12P, and radiated from the antenna element. A reception signal received by the antenna element is supplied to the feeding circuit through the connection pin 12P, the second high-frequency line portion 22, the matching circuit portion 30, the first high-frequency line portion 21, and the connector 11C.

The signal line SL1 of the first high-frequency line portion 21 is provided between a ground conductor G1 and a ground conductor G2 and has a tri-plate type strip line structure. In other words, the first high-frequency line portion 21 includes the signal line SL1, the ground conductor G1, and the ground conductor G2 of the first high-frequency line portion 21. Note that the ground conductor G1 is a solid plane conductor which will be described later, but the ground conductor G2 has a structure in which a plurality of openings and rungs are alternately and periodically provided in and on a plane conductor in the direction in which the signal line SL1 of the first high-frequency line portion 21 extends. The signal line SL1 of the first high-frequency line portion 21 is offset toward the ground conductor G2. As a result, the ground conductor G1 defines and functions as a reference ground for the signal line SL1 of the first high-frequency line portion 21 and the ground conductor G2 defines and functions as an auxiliary ground. In other words, in accordance with the line width of the signal line SL1 of the first high-frequency line portion 21 and the distance between the signal line SL1 of the first high-frequency line portion 21 and the ground conductor G1, an impedance is set in such a manner as to be a little higher (for example, about 55Ω) than a predetermined impedance (for example, about 50Ω). By configuring an appropriate capacitance component to be placed between the rungs in the ground conductor G2 and the signal line SL1 of the first high-frequency line portion 21, the characteristic impedance of the first high-frequency line portion 21 is set in such a manner that the impedance which has been set a little higher becomes a predetermined impedance (for example, about 50Ω).

The matching circuit portion 30 includes an inductance element inserted in series with a signal propagation path and a capacitance element connected as a shunt to the signal propagation path. The inductance element preferably is a chip inductor, and the capacitance element preferably is a chip capacitor. The chip inductor and chip capacitor are mounted on the other main surface side of the multilayer body as surface mount components. In other words, one end of the matching circuit portion 30 is connected to the second end of the signal line SL1 of the first high-frequency line portion 21 and the matching circuit portion 30 includes the chip inductor and the chip capacitor connected through interlayer connection conductors. The other end of the matching circuit portion 30 is connected to the second end of the signal line SL2 of the second high-frequency line portion 22 through an interlayer connection conductor. Surface mount components defining the matching circuit portion 30 is mounted on the other main surface side of the multilayer body, i.e., the ground conductor G1 side.

No ground conductors are arranged near the signal line SL2 of the second high-frequency line portion 22. In other words, the signal line SL2 of the second high-frequency line portion 22 does not have a microstrip line structure or a tri-plate type strip line structure, and is provided in the non-ground zone NGZ in the multilayer body. The signal line SL2 of the second high-frequency line portion 22 is provided on a layer the same as the layer on which the signal line SL1 of the first high-frequency line portion 21 is provided. In other words, the high-frequency line portions are offset toward the one main surface of the multilayer body.

On the one main surface side of the multilayer body, a resist layer R2 covers the ground conductor G2, and on the other main surface side of the multilayer body, a resist layer R1 covers an area except for mounting lands for surface mount components that define a first matching circuit.

Thermoplastic resin sheets, such as liquid crystal polymer sheets, may be used as a plurality of dielectric layers that define the multilayer body. The signal line SL1, the signal line SL2, the ground conductor G1, and the ground conductor G2 may be made of thin metal plates, such as silver or copper foils, which have been patterned in predetermined shapes. The interlayer connection conductors may be formed by filling via holes with conductive paste, mainly made of silver or copper, and metalizing the paste. Note that by stacking a plurality of thermoplastic resin sheets on top of one another and pressing them while being heated, the plurality of thermoplastic sheets can be unified and at the same time the conductive paste with which the via holes have been filled can be metalized.

As illustrated in FIG. 3A, the first high-frequency line portion 21 is configured such that the resist layer R1, the first ground conductor G1, a first base material layer B1, the signal line SL1, a second base material layer B2, the second ground conductor G2, and the resist layer R2 are stacked on top of one another in this order. However, this order does not represent the order of manufacturing steps. The first ground conductor G1 and the second ground conductor G2 are connected to each other through a via conductor VIA. Among the stacked components described above, the first ground conductor G1, the first base material layer B1, the signal line SL1, the second base material layer B2, and the second ground conductor G2 define a strip line.

The strip line described above preferably has the following characteristics described below.

The strip line is adjusted in such a manner that the overall characteristic impedance becomes about 50Ω, for example.

The second ground conductor G2 enhances overall flexibility and also defines and functions as a characteristics adjustment ground, as a result of having a ladder shape or substantially a ladder shape. As a result of the first ground conductor G1 not being shaped like a ladder or substantially like a ladder, i.e., being solid, the first ground conductor G1 is inhibited from being interfered with an external circuit or a metal body near the first ground conductor G1 and, at the same time, defines and functions as a reference ground.

The strip line defines portions having a high impedance and portions having a low impedance due to the ladder-shaped or substantially ladder-shaped the second ground conductor G2, and significantly reduces or prevents undesired resonance generated at both ends of the signal line. In other words, the distance (interval) between the ladder rungs is set in such a manner that generation of standing waves having unfavorable influence is significantly reduced or prevented. For example, the interval between the ladder rungs is set in such a manner as not to be multiples of the wavelengths of the basic wave and harmonics of an RF signal.

The signal line SL1 is configured to have a small width at portions thereof intersecting with the ground conductor G2. With this configuration, impedance at the portions intersecting with the ground conductor G2 is kept from becoming too small. As a result, continuity in the characteristic impedance of the strip line is assured between a portion intersecting with the ground conductor G2 and a portion not intersecting with the ground conductor G2.

As illustrated in FIG. 3B, in the matching circuit portion 30, the resist layer R1, the first ground conductor G1 (and line electrode), the first base material layer B1, a signal line SL0, the second base material layer B2, the second ground conductor G2, and the resist layer R2 are stacked on top of one another in this order. The matching circuit devices 30E are mounted on the first ground conductor G1 and line electrodes.

As illustrated in FIG. 3B, in the second high-frequency line portion 22, the resist layer R1, the first base material layer B1, the signal line SL2, and the second base material layer B2 are stacked on top of one another in this order. In the second connection portion 12, the resist layer R1, the first base material layer B1, the signal line SL2, and a connection pin terminal P are stacked on top of one another in this order. The connection pin 12P is bonded to the connection pin terminal P, although the illustration is omitted in FIG. 3B.

The second high-frequency line portion 22 includes the signal line SL2 not sandwiched between ground conductors in the vertical direction and, hence, the signal line SL2 of the second high-frequency line portion 22 defines and functions as a portion of the radiation portion RZ. The signal line SL2 of the second high-frequency line portion 22 is configured to fan out toward the wide end to match the size of the connection pin terminal P.

The matching circuit devices 30E include, for example, a chip inductor and a chip capacitor. For example, a capacitor connected as a shunt to the first ground conductor G1 and an inductor connected in series with the signal line SL define an impedance matching circuit 3. In this manner, the matching circuit portion 30 performs impedance matching between the first high-frequency line portion 21 having, for example, a characteristic impedance of about 50Ω and an antenna connected to the radiation portion RZ having an impedance of, for example, about 10Ω. The matching circuit devices 30E are located in the ground zone.

Second Preferred Embodiment

Figure 4:
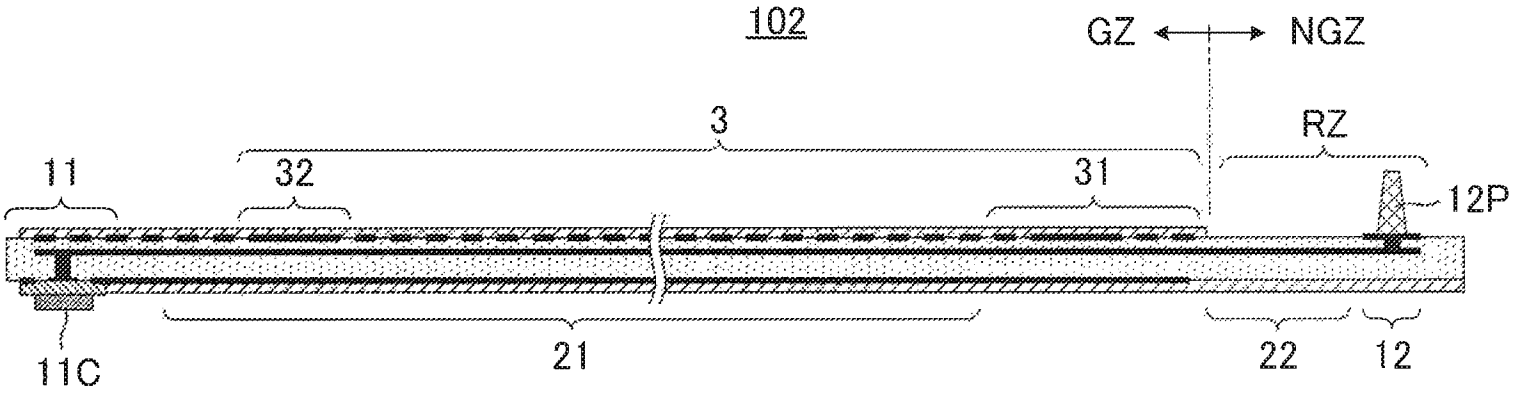
FIG. 4 is a longitudinal sectional view of a signal line module according to a second preferred embodiment of the present invention.

FIG. 4 is a longitudinal sectional view of a signal line module 102 according to a second preferred embodiment of the present invention. The connector 11C is provided in the first connection portion 11, and the connection pin 12P is provided in the second connection portion 12. The first connection portion 11, the first high-frequency line portion 21, and a first matching circuit portion 31 are provided in the ground zone GZ in which a ground conductor is located. The second high-frequency line portion 22, and the second connection portion 12 are provided in the non-ground zone NGZ in which no ground conductors are located. Unlike the example illustrated in FIG. 2, the first matching circuit portion 31 and a second matching circuit portion 32 are provided and these matching circuit portions are defined by conductor patterns.

Figure 5:
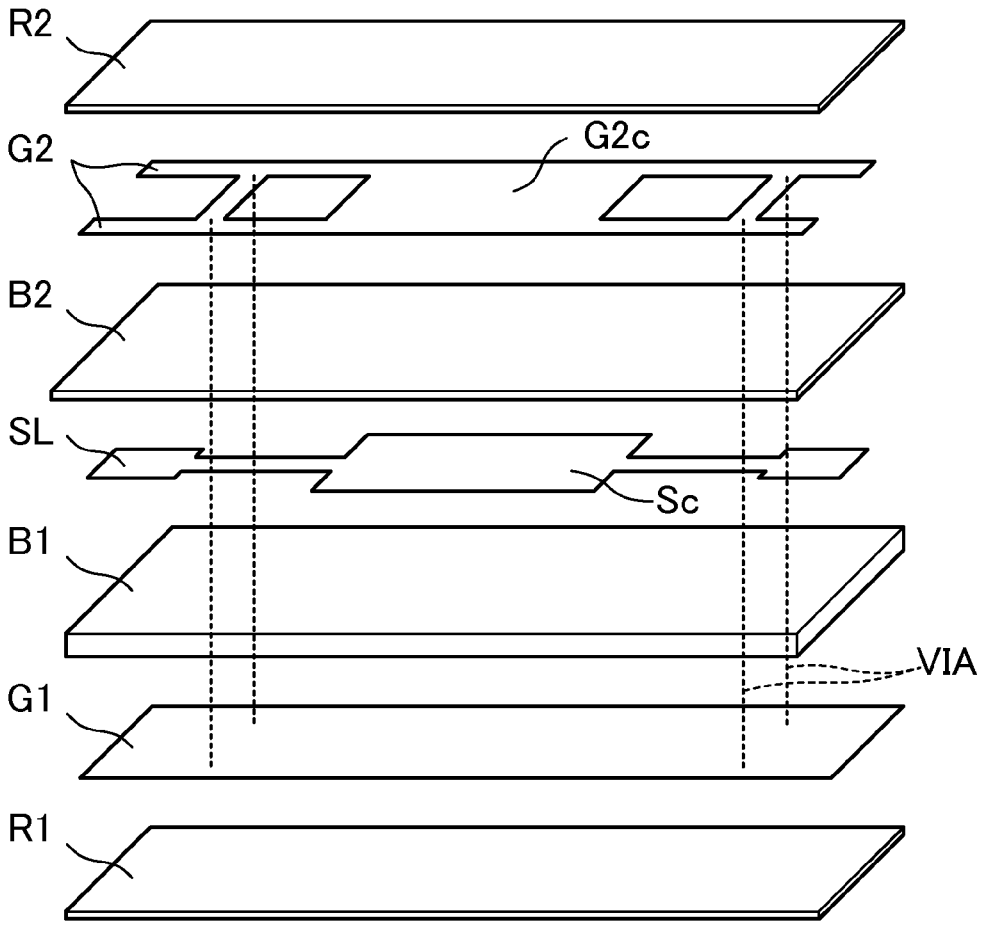
FIG. 5 is an exploded perspective view of a first matching circuit portion and a second matching circuit portion.

FIG. 5 is an exploded perspective view of the first matching circuit portion 31 and the second matching circuit portion 32. The first matching circuit portion 31 and the second matching circuit portion 32 preferably have the same or substantially the same stacking structure. Referring to FIG. 5, in the first or second matching circuit portion, the resist layer R1, the ground conductor G1, the first base material layer B1, the signal line SL, the second base material layer B2, the second ground conductor G2, and the resist layer R2 are stacked on top of one another in this order. A capacitance generating portion Sc is provided on the signal line SL and a capacitance generating portion G2*c* facing the capacitance generating portion Sc is provided on the ground conductor G2.

Figure 6:
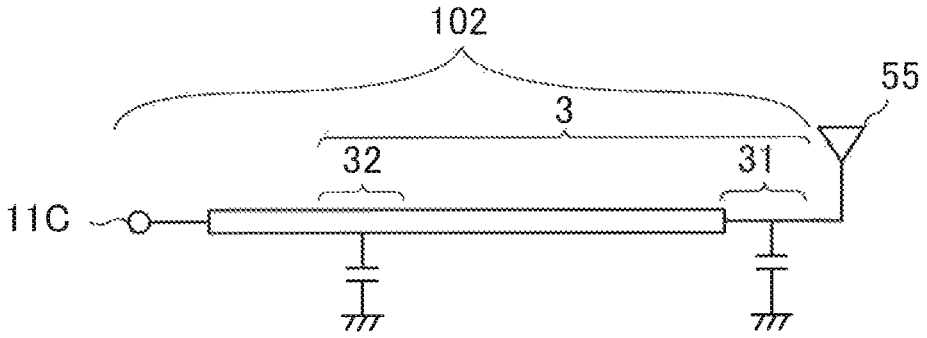
FIG. 6 is an equivalent circuit diagram of a portion including the signal line module illustrated in FIG. 4 and a radiation element.
Figure 7A:
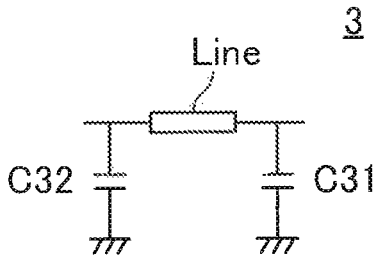
FIG. 7A and FIG. 7B are equivalent circuit diagrams illustrating more symbolic representations of FIG. 6.
Figure 7B:
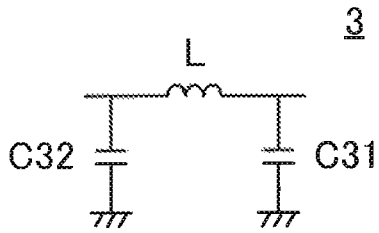

FIG. 6 illustrates an equivalent circuit of a portion including the signal line module 102 illustrated in FIG. 4 and the radiation element 55, and FIG. 7A and FIG. 7B are equivalent circuit diagrams illustrating more symbolic representations of the equivalent circuit. By providing the first matching circuit portion 31 and the second matching circuit portion 32 at two respective locations of the signal line as illustrated in FIG. 6, a circuit including capacitors C31 and C32 and a line LINE is provided, as illustrated in FIG. 7A. By providing the line LINE having an electrical length that enables it to operate as an inductor, the signal line module 102 operates as a CLC π-type matching circuit 3, as illustrated in FIG. 7B.

In this manner, the signal line module 102 with a matching circuit 3, almost all of which operates as a matching circuit 3, is provided.

Figure 8:
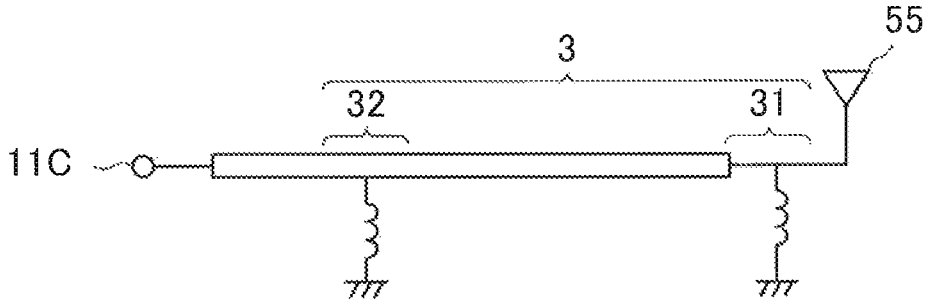
FIG. 8 is an equivalent circuit diagram of a portion including another signal line module according to the second preferred embodiment of the present invention and a radiation element.
Figure 9A:
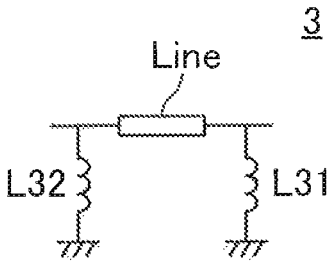
FIG. 9A and FIG. 9B are equivalent circuit diagrams of the other signal line module according to the second preferred embodiment of the present invention.
Figure 9B:
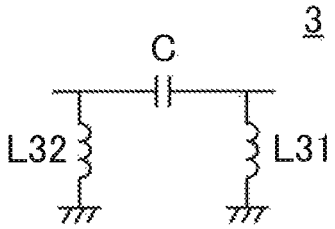

A CLC π-type matching circuit 3 has been provided in the example illustrated in FIG. 6 and FIGS. 7A and 7B. However, as illustrated in FIG. 8, the matching circuit 3 may have a configuration in which inductors are connected as shunts between the signal line and the ground. Equivalent circuits thereof are illustrated in FIG. 9A and FIG. 9B. Here, the line LINE preferably has an electric length that enables it to operate as a capacitor. In this manner, an LCL π-type matching circuit 3 is provided.

Third Preferred Embodiment

Figure 10A:
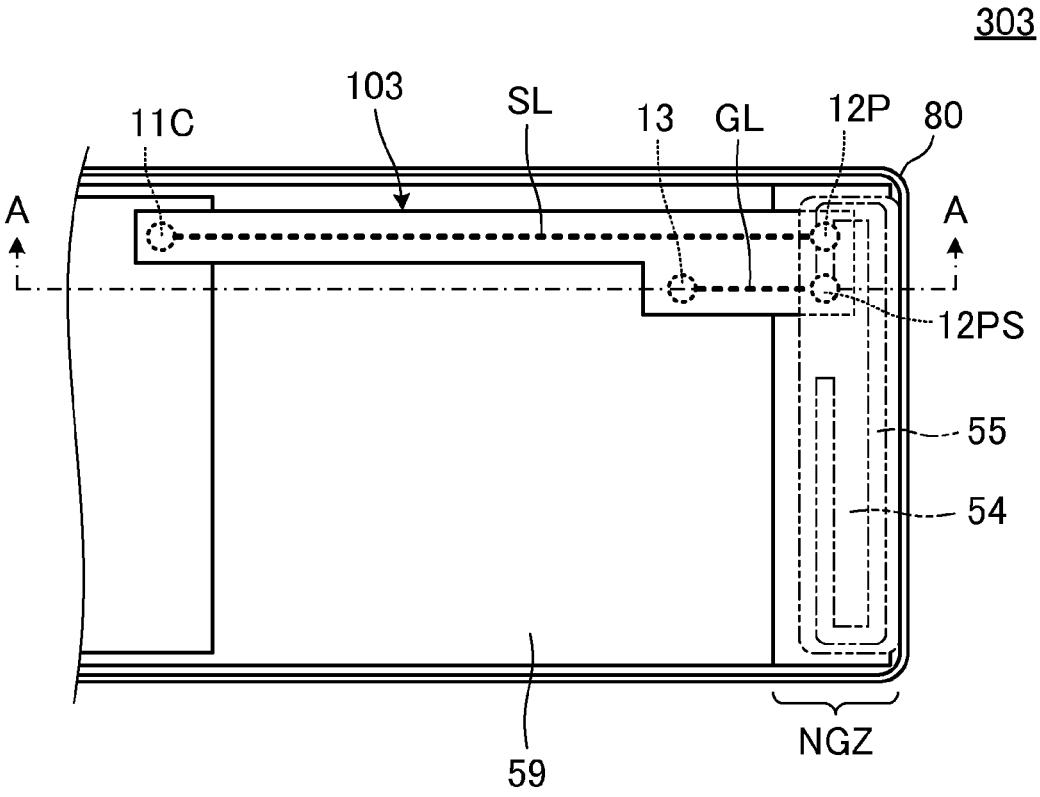
FIG. 10A is a diagram illustrating the structure of the inside of the main portions of a communication terminal apparatus on the upper casing side, the communication terminal apparatus including a signal line module according to a third preferred embodiment of the present invention, in a state in which the lower casing has been removed.
Figure 10B:
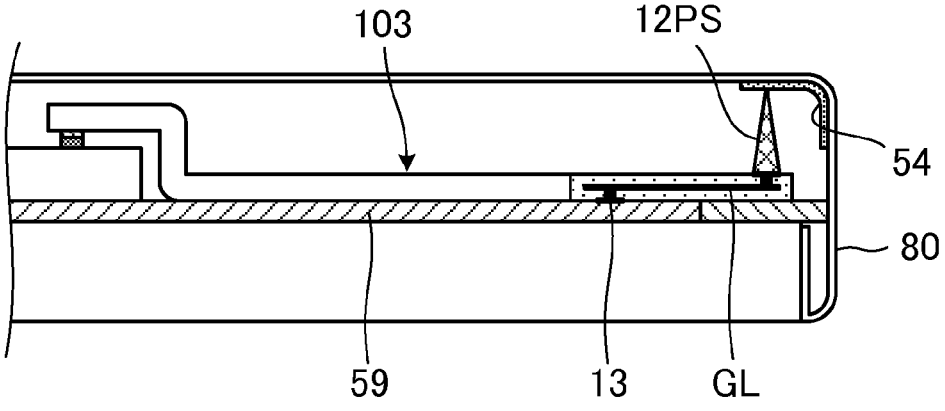
FIG. 10B is a longitudinal sectional view of the main portions of the communication terminal apparatus.

FIG. 10A is a diagram illustrating a communication terminal apparatus 303, including a signal line module 103 according to a third preferred embodiment of the present invention, in a state in which the lower casing (display-panel-side casing) has been removed, i.e., illustrating the internal structure of the main portions on the upper casing side. Note that the radiation board 54 that is attached to the inner surface of the lower casing is illustrated after detaching it from the lower casing. FIG. 10B is a longitudinal sectional view of the main portions of the communication terminal apparatus 303.

The radiation element 55 is provided on the radiation board 54. The connection pin 12P and a short pin 12PS are in contact with and electrically connected to predetermined positions of the radiation element 55. The termination end of the signal line SL is connected to the feeding point of the radiation element 55 through the connection pin 12P, such that feeding is performed. The result of the short pin 12PS coming into contact with the grounding point of the radiation element 55 is grounding this grounding point to a metal chassis 59 at a third connection point 13 through a ground line GL.

In this manner, the signal line module 103 is adapted to the radiation element 55 including a grounding point.

Fourth Preferred Embodiment

Figure 11:
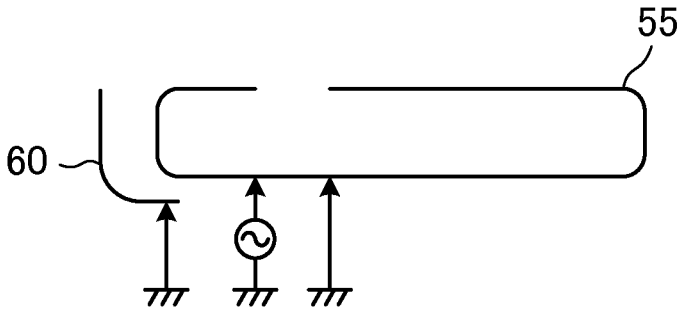
FIG. 11 is a circuit diagram of an antenna device including a signal line module according to a fourth preferred embodiment of the present invention.

FIG. 11 is a circuit diagram of an antenna device including a signal line module according to a fourth preferred embodiment of the present invention. In this example, the radiation element 55 (feeding radiation element) and a non-feeding radiation element 60 are provided on a radiation board. The signal line module includes a connection pin through which feeding is performed to the feeding point of the radiation element 55, a short pin in contact with the grounding point of the radiation element 55, and a short pin in contact with the grounding point of the non-feeding radiation element 60.

Fifth Preferred Embodiment

Figure 12:
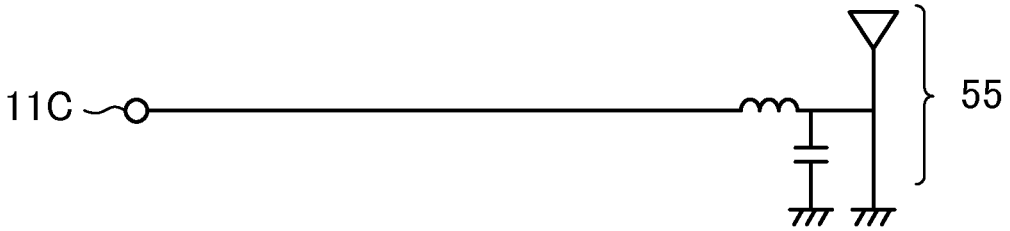
FIG. 12 is a circuit diagram of an antenna device including a signal line module according to a fifth preferred embodiment of the present invention.

FIG. 12 is a circuit diagram of an antenna device including a signal line module according to a fifth preferred embodiment of the present invention. In this example, the signal line module includes a connection pin configured to perform feeding to the feeding point of the radiation element 55 and a short pin in contact with the grounding point of the radiation element 55. A matching circuit including a capacitor connected as a shunt and an inductor connected in series is provided near the feeding point of the radiation element 55 in the signal line module.

In this manner, in the signal line module, a reverse F antenna is provided and a feeding circuit is defined by connecting the signal line module to the radiation element 55 using two pins.

Sixth Preferred Embodiment

Figure 13:
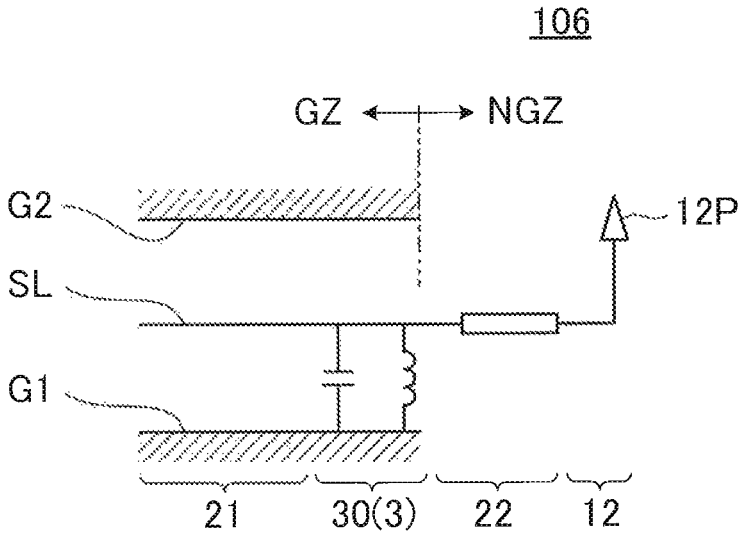
FIG. 13 is a conceptual sectional diagram of the main portions of a signal line module according to a sixth preferred embodiment of the present invention.
Figure 14:
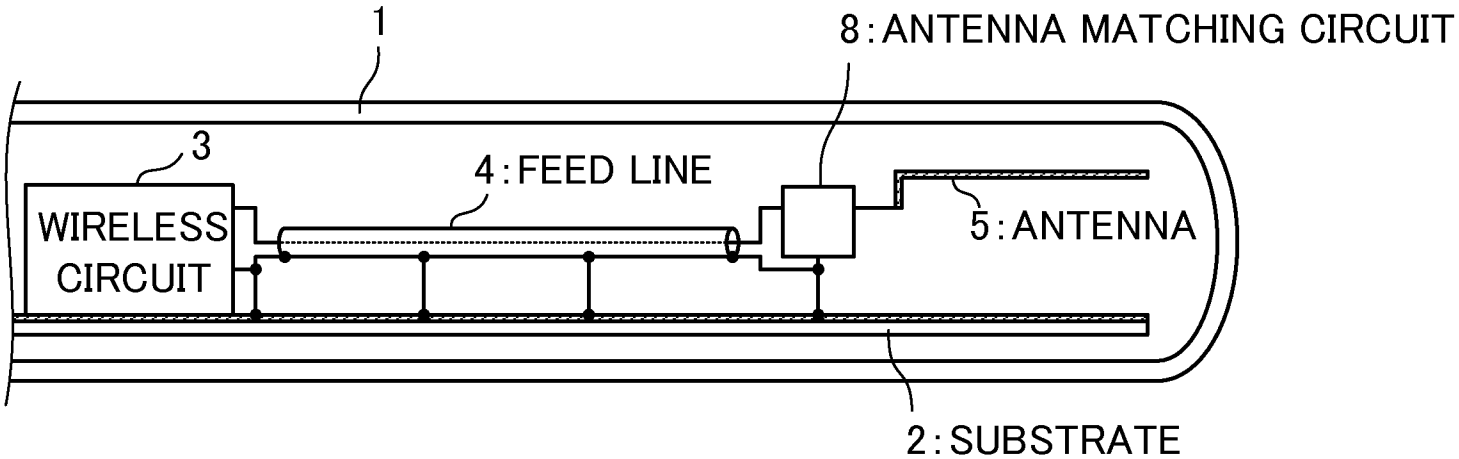
Fig.14 Prior Art
FIG. 14 is a schematic configuration diagram of a communication terminal apparatus disclosed in Japanese Unexamined Patent Application Publication No. 2006-325093.

FIG. 13 is a conceptual sectional diagram of the main portions of a signal line module 106 according to a sixth preferred embodiment of the present invention. The first high-frequency line portion 21 including a strip line structure includes the ground conductor G1, the ground conductor G2, and the signal line SL of the signal line module 106. An impedance matching circuit 3 including a capacitor and an inductor is provided in the matching circuit portion 30. The connection pin 12P is provided in the second connection portion 12. The rest of the basic configuration is preferably the same as those in the other preferred embodiments described above.

The second high-frequency line portion 22 is a phase adjustment line located in the non-ground zone NGZ, and this line and the circuit of the matching circuit portion 30 define a matching circuit 3.

The second high-frequency line portion 22 is a phase adjustment line located in the non-ground zone NGZ, and this line and the circuit of the matching circuit portion 30 define a matching circuit.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A signal line module comprising:

a first connection portion connected to a feeding circuit;

a second connection portion connected to a radiation element;

a first high-frequency line portion, one end of which is connected to the first connection portion;

a second high-frequency line portion, one end of which is connected to the second connection portion; and a first matching circuit portion between a second end of the first high-frequency line portion and a second end of the second high-frequency line portion and that defines all of or a portion of a matching circuit configured to perform impedance matching between the first high-frequency line portion and the second high-frequency line portion; wherein the first connection portion, the first high-frequency line portion, the second high-frequency line portion, and the second connection portion are integrally provided in a multilayer body including a plurality of base material layers stacked on top of one another;

the first connection portion and the first high-frequency line portion are in a ground zone superposed with a ground conductor, and the second high-frequency line portion and the second connection portion are outside of the ground zone, when viewed in plan in a stacking direction of the multilayer body;

the first high-frequency line portion includes:

a first signal line; and the ground conductor superposed with the first signal line when viewed in plan in the stacking direction of the multilayer body;

the second high-frequency line portion includes a second signal line not superposed with the ground conductor when viewed in plan in the stacking direction of the multilayer body;

all of or a portion of the ground conductor is arranged on a first side of the multilayer body;

the second signal line is arranged in a position closer to a second side of the multilayer body than to the first side; and the second high-frequency line portion and the second connection portion, together with the radiation element, define and operate as a radiation portion.

2. The signal line module according to claim 1, wherein the first matching circuit portion, together with the first high-frequency line portion, define the matching circuit.

3. The signal line module according to claim 1, wherein the first matching circuit portion includes a conductor in the multilayer body.

4. The signal line module according to claim 1, further comprising a third connection portion that is electrically connected to the ground conductor and that is connected to a grounding point of the radiation element or to a non-feeding radiation element.

5. The signal line module according to claim 1, wherein the first high-frequency line portion includes a second matching circuit portion; and the first high-frequency line portion, the first matching circuit portion, and the second matching circuit portion define the matching circuit.

6. The signal line module according to claim 1, wherein the ground conductor is one of a solid plane conductor and a structure including a plurality of openings and rungs to define a ladder shape or substantially a ladder shape.

7. The signal line module according to claim 1, further comprising another ground conductor, wherein the ground conductor is a reference ground for the first high-frequency line portion and the another ground conductor is an auxiliary ground.

8. The signal line module according to claim 1, wherein the first matching circuit portion includes an inductance element and a capacitance element.

9. The signal line module according to claim 1, wherein the first high-frequency line portion includes a first resist layer, a first base material layer, the ground conductor, a second base material layer, another ground conductor layer, and a second resist layer stacked in order.

10. The signal line module according to claim 1, wherein the second high-frequency line portion includes a first resist layer, a first base material layer, a signal line, and a second base material layer stacked in order.

11. The signal line module according to claim 1, wherein the matching circuit includes an inductor and a capacitor.

12. The signal line module according to claim 5, wherein the first matching circuit portion and the second matching circuit portion are defined by conductors.

13. The signal line module according to claim 1, wherein the matching circuit is one of a CLC π-type matching circuit and an LCL π-type matching circuit.

14. A communication terminal apparatus comprising:

a feeding circuit;

a radiation element; and a signal line module; wherein the feeding circuit and the radiation element are connected to each other through the signal line module; and the signal line module includes:

a first connection portion connected to the feeding circuit;

a second connection portion connected to the radiation element;

a first high-frequency line portion, one end of which is connected to the first connection portion;

a second high-frequency line portion, one end of which is connected to the second connection portion; and a first matching circuit portion between a second end of the first high-frequency line portion and a second end of the second high-frequency line portion and that defines all of or a portion of a matching circuit performing impedance matching between the first high- frequency line portion and the second high-frequency line portion; wherein the first connection portion, the first high-frequency line portion the second high-frequency line portion, and the second connection portion are integrally provided in a multilayer body including a plurality of base material layers on top of one another;

the first connection portion and the first high-frequency line portion are in a ground zone superposed with a ground conductor, and the second high-frequency line portion and the second connection portion are outside of the ground zone, when viewed in plan in a stacking direction of the multilayer body;

the first high-frequency line portion includes:

a first signal line; and the ground conductor superposed with the first signal line when viewed in plan in the stacking direction of the multilayer body;

the second high-frequency line portion includes a second signal line not superposed with the ground conductor when viewed in plan in the stacking direction of the multilayer body;

all of or a portion of the ground conductor is arranged on a first side of the multilayer body;

the second signal line is arranged in a position closer to a second side of the multilayer body than to the first side; and the second high-frequency line portion and the second connection portion, together with the radiation element, define and operate as a radiation portion.

15. The communication terminal apparatus according to claim 14, wherein the communication terminal apparatus is a smart phone.

16. The communication terminal apparatus according to claim 14, further comprising a case and a radiation board on which the radiation element is provided, wherein the radiation board is attached to an inner surface of the case.

17. The communication terminal apparatus according to claim 14, further comprising a connection pin and another pin are in contact with the radiation element.

18. The communication terminal apparatus according to claim 14, further comprising a radiation board and a non-feeding radiation element, wherein the radiation element and non-feeding radiation element are provided on the radiation board.

19. The communication terminal apparatus according to claim 14, further comprising a connection pin configured to perform feeding to a feeding point of the radiation element and a another pin in contact with a grounding point of a radiation element.

* * * * *